US006952915B2

(12) United States Patent
Prickett

(10) Patent No.: US 6,952,915 B2
(45) Date of Patent: Oct. 11, 2005

(54) PLY-TWISTED YARNS AND FABRIC HAVING BOTH CUT-RESISTANCE AND ELASTIC RECOVERY AND PROCESSES FOR MAKING SAME

(75) Inventor: Larry John Prickett, Chesterfield, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 156 days.

(21) Appl. No.: 10/696,059

(22) Filed: Oct. 29, 2003

(65) Prior Publication Data

US 2005/0091961 A1 May 5, 2005

(51) Int. Cl.[7] ..... D02G 3/02; D02G 3/36

(52) U.S. Cl. ..... 57/211; 57/238

(58) Field of Search ..... 57/210, 211, 224, 57/225, 229, 236, 238, 902; 152/556, 557

(56) References Cited

U.S. PATENT DOCUMENTS

| | | | |
|---|---|---|---|
| 2,929,801 | A | 3/1960 | Koller |
| 2,929,802 | A | 3/1960 | Katz |
| 2,929,803 | A | 3/1960 | Frazer et al. |
| 2,929,804 | A | 3/1960 | Steuber |
| 2,953,839 | A | 9/1960 | Kohm et al. |
| 2,957,852 | A | 10/1960 | Frankenburg et al. |
| 2,962,470 | A | 11/1960 | Jung |
| 2,999,839 | A | 9/1961 | Arvidson, Jr. et al. |
| 3,009,901 | A | 11/1961 | Frazer |
| 3,063,966 | A | 11/1962 | Kwolek et al. |
| 3,767,756 | A | 10/1973 | Blades |
| 3,869,429 | A | 3/1975 | Blades |
| 3,869,430 | A | 3/1975 | Blades |
| 4,004,295 | A | 1/1977 | Byrnes, Sr. |
| 4,107,909 | A | 8/1978 | Fehrer et al. |
| 4,121,408 | A | 10/1978 | Maeda |
| 4,249,368 | A | 2/1981 | Fehrer |
| 4,327,545 | A | 5/1982 | Fehrer |
| 4,384,449 | A | 5/1983 | Byrnes, Sr. et al. |
| 4,457,985 | A | 7/1984 | Harpell et al. |
| 4,470,251 | A | 9/1984 | Bettcher |
| 4,967,548 | A | 11/1990 | Fangeat et al. |
| 5,119,512 | A | 6/1992 | Dunbar et al. |
| 5,231,700 | A | 8/1993 | Cutshall |
| 5,248,548 | A | 9/1993 | Toon |
| 5,287,690 | A | 2/1994 | Toon |
| 5,319,950 | A | 6/1994 | Whitt et al. |
| 5,442,815 | A | 8/1995 | Cordova et al. |
| 5,617,713 | A | 4/1997 | Mawick et al. |
| 6,044,493 | A | 4/2000 | Post |
| 6,534,175 | B1 | 3/2003 | Zhu et al. |
| 2003/0037530 | A1 | 2/2003 | Zhu |
| 2003/0074879 | A1 | 4/2003 | Patrick |
| 2004/0065072 | A1 * | 4/2004 | Zhu et al. ..... 57/314 |

FOREIGN PATENT DOCUMENTS

| | | |
|---|---|---|
| EP | 1 180 555 A1 | 2/2002 |
| GB | 1 586 890 A | 3/1981 |
| WO | WO 03/016602 A1 | 2/2003 |

* cited by examiner

*Primary Examiner*—John J. Calvert
*Assistant Examiner*—Shaun R. Hurley

(57) ABSTRACT

The present invention relates to ply-twisted yarn and cut-resistant fabric for use in articles of protective clothing. The fabric is cut resistant and form fitting by virtue of cut-resistant synthetic fibers, inorganic fibers and elastomeric fibers being combined in a particular manner.

20 Claims, 3 Drawing Sheets

PLY-TWISTED YARNS AND FABRIC HAVING BOTH CUT-RESISTANCE AND ELASTIC RECOVERY AND PROCESSES FOR MAKING SAME

BACKGROUND OF THE INVENTION

1. Field of the Invention

This invention relates to ply-twisted yarns and cut resistant fabric for use in articles of protective clothing. The fabric is cut resistant and form fitting by virtue of cut resistant synthetic fibers, inorganic fibers and elastomeric fibers being combined in a particular manner.

2. Description of Related Art

U.S. Pat. No. 6,534.175 discloses a cut resistant fabric made from at least one cut resistant yarn comprising a first strand, which is a sheath/core yarn having a sheath of cut resistant staple fibers and a metal fiber core, plied with a second strand, which is a yarn comprising cut resistant fibers free of metal fibers. The specification discloses the second strand may contain some fibers of other materials, such as cotton or nylon or the like. The individual filaments or fibers in this strand have a linear density of 0.5 to 7 dtex.

PCT publication WO 03/016602 discloses a cut resistant yarn comprising at least one continuous synthetic elastomeric filament and a plurality of bulked continuous cut-resistant filaments. The bulked continuous cut-resistant filaments have a random entangled loop structure in the yarn.

U.S. Pat. No. 5,617,713 discloses a yarn having discrete metallic fibers and an electromagnetic shield fabric and gloves made from those yarns.

U.S. Pat. Nos. 5,287,690; 5,248,548; 4,470,251; 4,384,449; and 4,004,295, all disclose the use of yarns having metallic fiber cores and high strength synthetic fiber wrappings to make fabrics used in cut resistant articles of clothing.

U.S. Pat. No. 5,119,512 discloses a cut protective fabric made from cut resistant yarn comprising two dissimilar non-metallic fibers, at least one non-metallic fiber being flexible and inherently cut resistant and the other having a hardness level of above about three Mohs on the hardness scale.

U.S. Pat. Nos. 5,231,700; 5,442,815; and 6,044,493 disclose the use of elastomeric materials in cut resistant articles.

BRIEF SUMMARY OF THE INVENTION

This invention relates to a ply-twisted yarn for use in cut resistant fabric, and the fabric and a cut-resistant article made from such yarn, wherein the ply-twisted yarn comprises:

(a) at least one single yarn having a sheath/core construction with a sheath comprising cut-resistant staple fibers and a core comprising an inorganic fiber; and (b) at least one single yarn comprising cut resistant staple fiber and at least one elastomeric filament and being free or substantially free of inorganic fibers. The ply-twisted yarn is preferably ply-twisted with a Tex system twist multiplier of 4.8 to 28.7, preferably 6.7 to 20 (cotton count twist multiplier of 0.5 to 3.0, preferably 0.7 to 2.1).

This invention further relates to a cut-resistant fabric made from a bundle of yarns, and a cut-resistant article made from such fabric, said bundle of yarns comprising:

(a) at least one single yarn having a sheath/core construction with a sheath comprising cut-resistant staple fibers and a core comprising an inorganic fiber; and (b) at least one single yarn comprising cut resistant staple fiber and at least one elastomeric filament and being free or substantially free of inorganic fibers.

This invention also includes a process for making the above-mentioned ply-twisted yarns for use in cut-resistant fabrics and a process for making the above-mentioned cut-resistant fabric from a bundle of yarns.

DETAILED DESCRIPTION OF THE INVENTION

Cut resistant fabrics are very important for protection in coverings and apparel such as gloves and the like. Along with cut resistance, it is often important or desirable for any articles made from such fabrics be comfortable and have good fit and dexterity. By "good fit and dexterity" it is meant, for example, that gloves conform nicely to the shape of the hands of the wearer and one is able to pick up and manipulate small objects while wearing the gloves. The fabric of this invention is highly cut resistant, soft, flexible, and form fitting. Protective apparel made from such fabric is very comfortable and effective.

Ply-Twisted Yarns

The ply-twisted yarns of this invention are made by twisting together at least two individual single yarns. It is well known in the art to twist single yarns together to make ply-twisted yarns. Each single yarn can be, for example, a collection of staple fibers spun into what is known in the art as a spun staple yarn.

Figure 1:
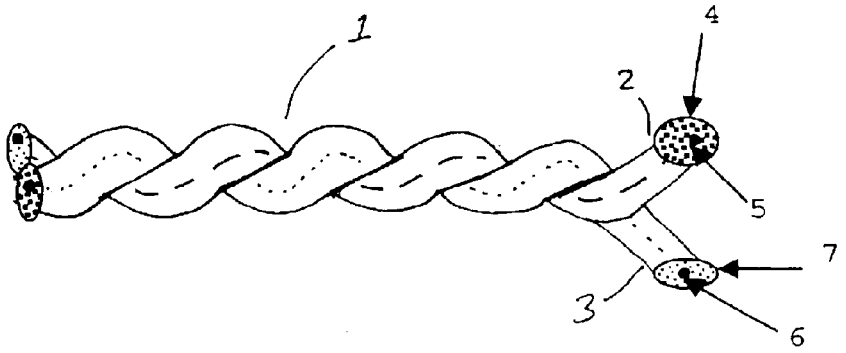
FIG. 1 is a representation of a ply-twisted yarn used in a fabric of this invention.

By the phrase "twisting together at least two individual single yarns", it is meant the two single yarns are twisted together without one yarn fully covering the other. This distinguishes ply-twisted yarns from covered or wrapped yarns where a first single yarn is completely wrapped around a second single yarn so that the surface of the resulting ply-twisted yarn only exposes the first single yarn. FIG. 1 illustrates ply-twisted yarn 1 made from single yarns 2 and 3. Single yarn 2 is a sheath/core single yarn having a staple fiber sheath 4 and an inorganic core 5. The inorganic core is represented as a dashed line in the yarn. Single yarn 3 is an elastomeric single yarn comprising and elastomeric filament 6 and staple fiber 7. The elastomeric filament is represented as a dotted line in the yarn. The single yarns may have twist which is not shown in figure for the purposed of clarity.

The ply-twisted yarns of this invention are preferably made up of at least two different single yarns. The ply-twisted yarns also preferably have a total linear density of from 300 to 2000 dtex. The individual staple fibers in a single yarn typically have a linear density of 0.5 to 7 dtex, with the preferred range being 1.5 to 3 dtex. The ply-twisted yarns, and the single yarns that make up those ply-twisted yarns, can include other materials as long as the function or performance of the yarn or fabric made from that yarn is not compromised for the desired use.

Sheath/Core Single Yarns

Figure 2:
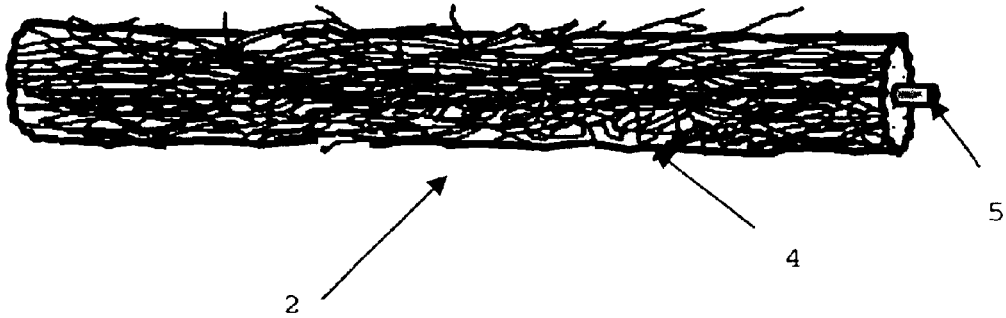
FIG. 2 is a representation of a single yarn used in the ply-twisted yarn of the fabric of this invention, the single yarn having a sheath/core construction with a sheath of cut resistant staple fibers and an inorganic fiber core.

The ply-twisted yarn of this invention includes a single yarn having a sheath/core construction, the sheath being organic cut resistant staple fiber and the core being at last one inorganic filament. A sheath/core construction is used because the organic cut resistant staple fibers cover and shield the inorganic filament from direct abrasive contact with other materials, which also give fabrics containing the yarn improved comfort. FIG. 2 is a preferred representation of such a single yarn form. Single yarn 2 has so-called sheath/core construction that involves a continuous inorganic filament core 5 and an organic staple fiber sheath 4.

The organic cut resistant staple fiber sheath 4 can be wrapped or spun around inorganic filament core 5. These can be achieved by known means, such as, conventional ring spinning including improvements to the conventional process such as those utilizing COTSON technology; core-spun spinning such as DREF spinning; air-jet spinning using so-called core insertion with Murata (now Muratec) jet-like spinning; open-end spinning, and the like. Preferably the staple fiber is consolidated around the inorganic filament core at a density sufficient to cover the core. The degree of coverage depends on the process used to spin the yarn; for example, core-spun spinning such as DREF spinning (disclosed, for example, in U.S. Pat. Nos. 4,107,909; 4,249,368; & 4,327,545) provides better coverage than ring spinning. Conventional ring spinning provides only partial coverage of the center core but even partial coverage is assumed a sheath/core structure for the purposes of this invention. The sheath can also include some fibers of other materials to the extent that decreased cut resistance, due to that other material, can be tolerated Single yarns with a inorganic filament core and an organic cut resistant staple fiber sheath, such as single yarn 5, are generally 1 to 50 weight percent inorganic with a total linear density of 100 to 5000 dtex.

Cut Resistant Fibers

The organic cut-resistant staple fibers preferably used in this invention have a length of preferably 2 to 20 centimeters, preferably 3.5 to 6 centimeters. They preferably have a diameter of 5 to 25 micrometers and a linear density of 0.5 to 7 dtex.

The organic cut resistant staple fibers of have a cut index of at least 0.8 preferably a cut index of 1.2 or greater. The most preferred staple fibers have a cut index of 1.5 or greater. The cut index is the cut performance of a 475 grams/square meter (14 ounces/square yard) fabric woven or knitted from 100% of the fiber to be tested, which is then measured by ASTM F1790-97 (measured in grams, also known as the Cut Protection Performance (CPP) divided by the areal density (in grams per square meter) of the fabric being cut. A table of useful fibers and their cut performance is listed below. The CPP values listed below are averages of fabric weights that have an areal density of about 475 grams/square meter (14 ounces/square yard). Individual measurements made from a range of fabric weights may have slightly different Cut Index values than the values below.

| Fiber | Areal Density (g/m2) | CPP (g) | Cut Index (g/g/m2) |
|---|---|---|---|
| PPD-T | 475 | 1050 | 2.2 |
| Cotton | 475 | 425 | 0.9 |
| Blends of 40 to 80 wt. % Cotton & 20 to 60 wt. % PPD-T | 475 | 550–850 | 1.2–1.8 |
| Ultra-High MW Polyethylene | 475 | 900 | 1.9 |
| Polyamide (nylon) | 475 | 650 | 1.4 |
| Polyester | 475 | 650 | 1.4 |

The preferred staple fibers are para-aramid fibers. By para-aramid fibers is meant fibers made from para-aramid polymers; poly(p-phenylene terephthalamide) (PPD-T) is the preferred para-aramid polymer. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which do not adversely affect the properties of the para-aramid.

Additives can be used with the para-aramid in the fibers and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

P-aramid fibers are generally spun by extrusion of a solution of the p-aramid through a capillary into a coagulating bath. In the case of poly(p-phenylene terephthalamide), the solvent for the solution is generally concentrated sulfuric acid, the extrusion is generally through an air gap into a cold, aqueous, coagulating bath. Such processes are well known and do not form a part of the present invention. They are generally disclosed in U.S. Pat. No. 3,063,966; 3,767,756; 3,869,429, & 3,869,430. P-aramid fibers are available commercially as Kevlar® fibers, which are available from E. I. du Pont de Nemours and Company, and Twaron® fibers, which are available from Teijin, Ltd.

Other preferred cut resistant fibers useful in this invention are ultra-high molecular weight or extended chain polyethylene fiber generally prepared as discussed in U.S. Pat. No. 4,457,985. Such fiber is commercially available under the trade names of Dynema® available from Toyobo and Spectra® available from Honeywell. Other preferred cut resistant fibers are aramid fibers based on copoly(p-phenylene/3,4'-diphenyl ether terephthalamide) such as those known as Technora® available from Teijin, Ltd. Less preferred but still useful at higher weights are fibers made from polybenzoxazoles such as Zylon® available from Toyobo; anisotropic melt polyester such as Vectran® available from Celanese; polyamides; polyesters; and blends of preferred cut resistant fibers with less cut resistant fibers.

Inorganic Filaments

Inorganic filament core 5 can be a single filament or may be multifilament, and is preferably a single metal filament or several metal filaments, as needed or desired for a particular situation. By metal filament is meant filament or wire made from a ductile metal such as stainless steel, copper, aluminum, bronze, and the like, or metal fiber constructions commonly known as "micro-steel". Stainless steel is the preferred metal. The metal filaments are generally continuous wires. Useful metal filaments are 1 to 150 micrometers in diameter, and are preferably 25 to 75 micrometers in diameter.

For the purposes of this invention, the inorganic core may be one or more glass filaments, such as for example 110 dtex (100 denier) glass filament. However, glass is less preferred because it has less cut resistance per linear density than metal and it is much more critical that the glass be substantially covered by the staple fiber sheath to minimize skin irritation should the yarn be used in gloves, sleeves, etc., where the fabric is in contact with the skin.

Elastomeric Single Yarns

The fabric of this invention includes a single yarn containing at least one elastomeric filament. This can include the form of a sheath/core single yarn having the elastomeric filament(s) as the core and staple fiber as the sheath, although it is not critical that the elastomeric filament(s) actually be fully covered by the sheath.

The preferred elastomeric fiber is a spandex fiber, however, any fiber generally having stretch and recovery can be used. As used herein, "spandex" has its usual definition, that is, a manufactured fiber in which the fiber-forming substance is a long chain synthetic polymer composed of at least 85% by weight of a segmented polyurethane.

Among the segmented polyurethanes of the spandex type are those described in, for example, U.S. Pat. Nos. 2,929,801; 2,929,802; 2,929,803; 2,929,804; 2,953,839; 2,957,852; 2,962,470; 2,999,839; and 3,009,901.

Figure 3:
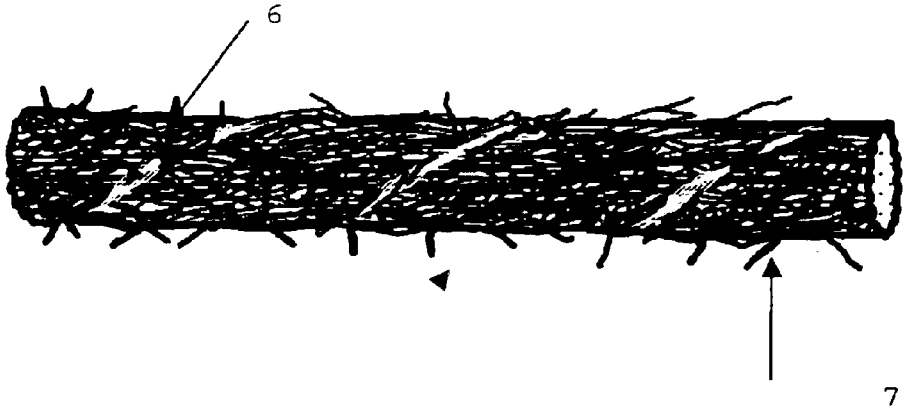
FIG. 3 is a representation of a single yarn used in the ply-twisted yarn of the fabric of this invention, the single yarn having combining staple fibers and elastomeric filament(s).

Single yarns with an elastomeric filament core, are illustrated in FIG. 3. Ring-spun elastomeric single yarn 3 is shown having at least one elastomeric filament 6 and a partially covering ring-spun sheath 7 of staple fiber. The elastomeric filament(s) comprising 2 to 25 weight percent of the total sheath/core single yarn linear density of 100 to 5000 dtex. In some processes for making spandex elastomeric filaments, coalescing jets are used to consolidate the spandex filaments immediately after extrusion. It is also well known that dry-spun spandex filaments are tacky immediately after extrusion. The combination of bringing a group of such tacky filaments together and using a coalescing jet will produce a coalesced multifilament yarn, which is then typically coated with a silicone or other finish before winding to prevent sticking on the package. Such a coalesced grouping of filaments, which is actually a number of tiny individual filaments adhering to one another along their length, is superior in many respects to a single filament of spandex of the same linear density.

The elastomeric filament in the elastomeric single yarn used in this invention is preferably a continuous filament and can be present in the single elastomeric yarn in the form of one or more individual filaments or one or more coalesced grouping of filaments. However, it is preferred to use only one coalesced grouping of filaments in the preferred elastomeric single yarn. Whether present as one or more individual filaments or one or more coalesced groupings of filaments the overall linear density of the elastomer filament(s) in the relaxed state is generally between 17 and 560 dtex (15 and 500 denier) with the preferred linear density range being 44 to 220 dtex (40 to 200 denier).

It is preferred to incorporate the elastomeric fiber into an elastomeric single yarn under tension by drawing or stretching the fiber prior to the combination with staple fibers by using a slower delivery speed of the elastomeric fiber relative to the final elastomeric single yarn speed. This drawing can be described as the stretch ratio of the elastomeric fiber, which is the final elastomeric single yarn speed divided by the delivery speed of the elastomeric fiber. Typical stretch ratios are 1.5 to 5.0 with 1.5 to 3.50 being preferred. Low stretch ratios yield less elastic recovery while very high stretch ratios make the single yarns difficult to process and the fabric too tight and uncomfortable. The optimum stretch ratio is also dependent on the % weight content of elastomeric core. Tension devices can also be employed to tension and stretch the elastomeric fiber but are less preferred due to the difficulty in reproducing and controlling tension and stretch. The optimum stretch ratio is ultimately determined for each fabric, based on the desired fit and feel of the fabric.

Figure 4:
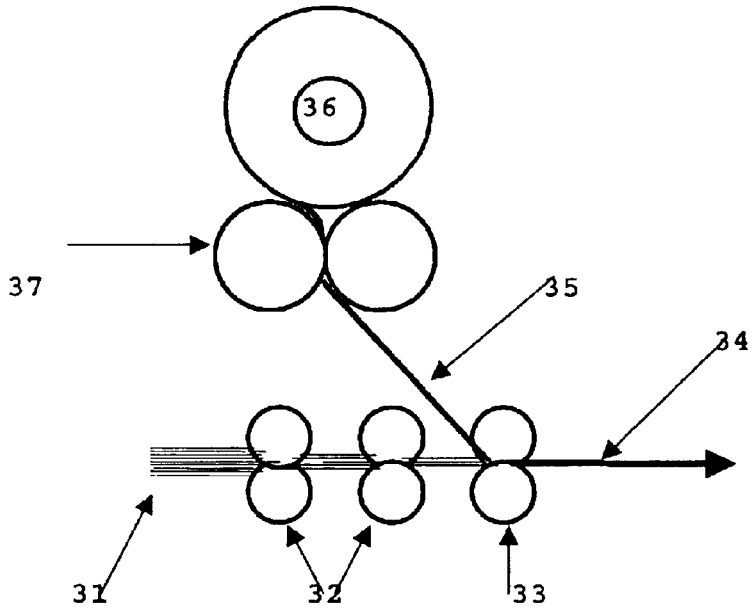
FIG. 4 is a representation of the process for incorporating an elastomeric fiber into a single yarn of cut resistant staple fibers.

FIG. 4 is a representation of one method for incorporating an elastic fiber into a single yarn of cut resistant staple fibers. For example, a roving, sliver, or collection of cut resistant staple fibers 31 may be drafted by sets of draft rolls 32 and 33 to make a drafted fiber mass 34 to be ring twisted into a single yarn. Elastomeric fiber 35 is fed from a bobbin 36 through a set of feed rolls 37 and subsequently into the staple fibers prior to the final set of drafting rollers 33. The slower relative surface speed of the feed rollers 37 to the surface speed of the drafting rollers 33 is increased or decreased to determine the amount of elastic stretch and tension in the final ring-twisted single yarn using conventional techniques.

Process for Making Ply-twisted Yarns

This invention also relates to a process for making a ply-twisted yarn for a cut resistant fabric by combining a first single yarn, comprising a cut resistant staple fiber and at least one elastomeric filament, with a second single yarn having a sheath/core construction with a sheath of cut resistant staple fibers and a metal fiber core; and then twisting together the first and second single yarns to form a ply-twisted yarn. The elastomeric filament is preferably free of metal fibers and the elastomeric fiber is incorporated into the first single yarn while under tension.

The ply-twisted yarns of this invention can be made from single yarns using either a two-step or combined process. In the first step of the two-step process, two or more single yarns are combined parallel to one another with no ply twist and wound onto a package. In the next step, the two or more combined yarns are then ring twisted together with the reverse twist of the single yarns to form a ply-twisted yarn. Ply-twisted yarns normally have "Z" twist (single yarns normally have "S" twist). Alternatively, a combined process can be employed to ply twist the singled yarns, which combines both of these steps in one operation. Equipment commonly used to ply twist single yarns is sold by equipment manufacturers such as Volkmann and Muratec (formerly Murata).

The ply-twisting is accomplished by twisting the single yarns the ply-twisted yarns having a Tex system twist multiplier of from 4.8 to 28.7, preferably 6.7 to 20. (This is equivalent to a cotton count twist multiplier of from 0.5 to 3.0, preferably 0.7 to 2.1). Twist multiplier is well known in the art and is the ratio of turns per inch to the square root of the yarn count The twist multiplier (TM) of a yarn can be defined using any of several dimensional systems:

Tex System: TM=(turns/centimeter)$(tex)^{1/2}$

Cotton System: TM=(turns/inch)/(cotton count of yarn)$^{1/2}$

Metric Count System: TM=(turns/meter)/(metric count of yarn)$^{1/2}$

"Cotton Count" of a yarn is the number of skeins of the yarn 768 meters (840 yards) long to have a weight of 454 grams (one pound). "Metric Count" of a yarn is the number of kilometers of the yarn to have a weight of one kilogram. For the purposes herein, the Tex System Twist Multiplier using SI units of $tex^{1/2}$ turns/cm will be used. The ply-twisted yarns may then be combined with other same or different ply-twisted yarns to form a yarn bundle to form a fabric, or the individual ply-twisted yarns can be used to form the fabric, depending on the desired fabric requirements.

Combinations of Single Yarns

It is preferred that one to three ply-twisted yarns be combined into a bundle of yarns for weaving or knitting cut resistant fabrics. Fabric properties can be changed by the addition of other single yarns made from staple fibers that do not contain inorganic or elastomeric filaments into the ply-twisted yarns or into the bundle of yarns. Preferably, these single yarns contain organic cut resistant fiber. Such single yarns generally have a linear density of 100 to 5000 dtex.

Figure 5:
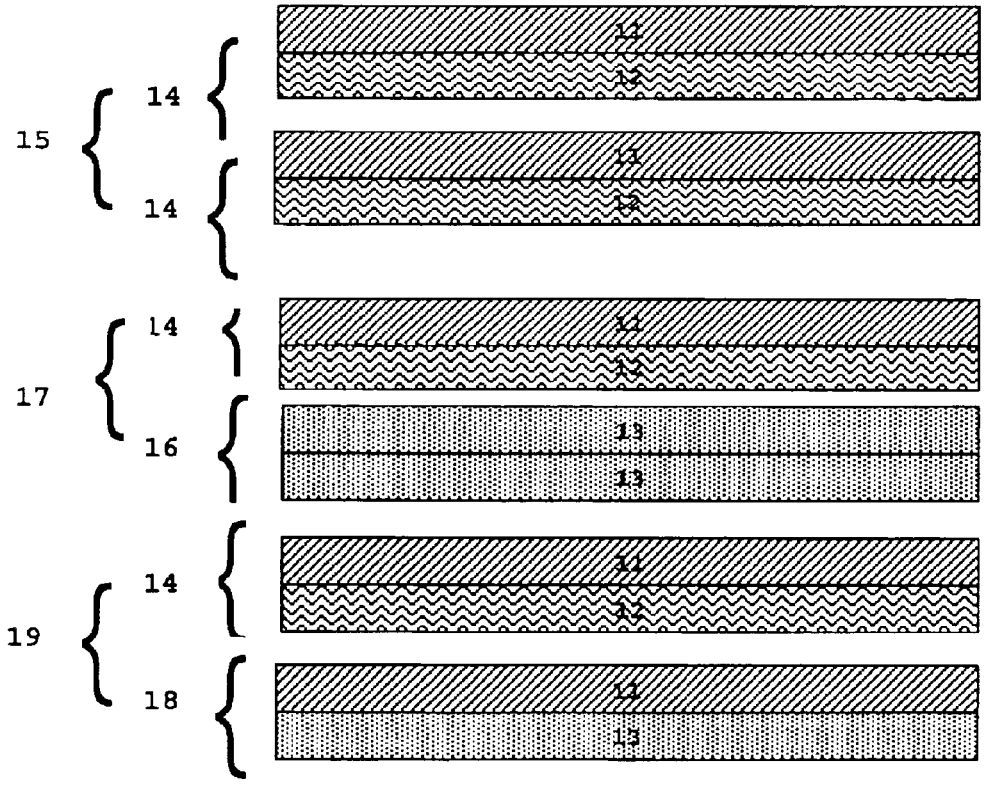
FIG. 5 is a schematic representation of possible combinations of single yarns to form ply-twisted yarns and yarn bundles made from 2 ply-twisted yarns.
Figure 6:
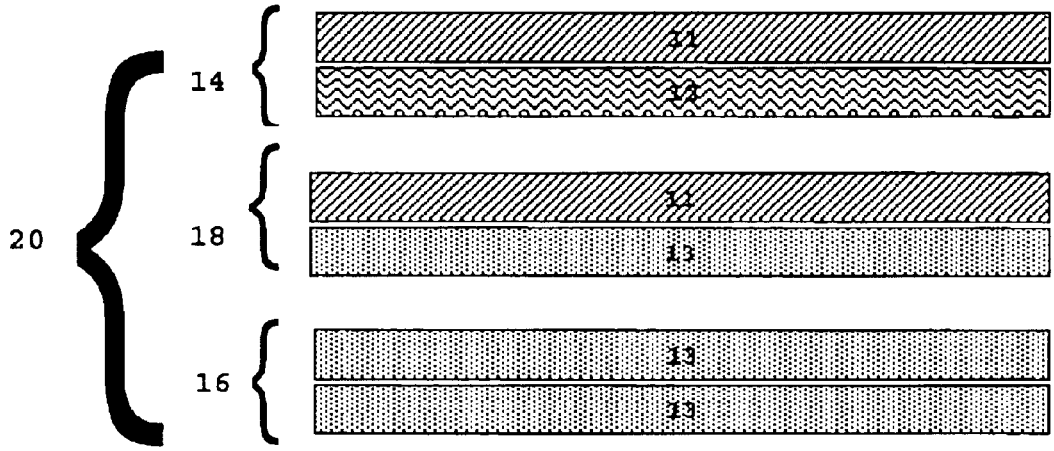
FIG. 6 is a schematic representation of possible combinations of single yarns to form ply-twisted yarns and yarn bundles made from more than 2 ply-twisted yarns.

Possible combinations of single yarns used in the ply-twisted yarns of this invention, given as an illustration and not meant to be limiting, are shown in FIG. 5. This includes the schematic representation of the combination of a staple fiber sheath/inorganic core single yarn 11 ply-twisted with staple fiber sheath/elastomer core single yarn 12 to make ply-twisted yarn 14. (The ply-twisted nature of 11 and 12 is not shown to better represent the composition of the single yarns.) Two ply-twisted yarns are put together to form bundle 15, which could be fed to a knitting machine with or without twist. Alternatively, the yarn bundle 17 could be made, which consists of ply-twisted yarn 14 combined with ply-twisted yarn 16, made up of two single yarns of fiber 13, which does not have either inorganic or elastomer filaments and preferably contains cut resistant staple fiber. Another alternative yarn bundle 19 could be made, where ply-twisted yarn 14 is combined with a ply-twisted yarn 18 comprising a staple fiber sheath/inorganic core single yarn 11 and a single yarn of fiber 13. More than two ply-twisted yarns can be used in a yarn bundle. For example, if a three-yarn bundle is desired, yarn bundle 20 can be formed using ply-twisted yarns 14, 18, and 16 as shown in the FIG. 6. A similar bundle could be formed with three of the ply-twisted yarns 14. Many combinations are possible, depending on the number of ply-twisted yarns desired in the yarn bundle and the amount of cut protection and stretch and recovery desired.

The single yarns, whether including an inorganic or elastomeric filament core or not, can have some twist. The ply-twisted yarns, also, can have some twist and the twist in the ply-twisted yarn is generally opposite the twist in the single yarns. In any of the single yarns twist is generally in the range of 19.1 to 38.2 twist multiplier (2 to 4cotton count twist multiplier). Since modern knitting machines can knit fabric from a feed of multiple ply-twisted yarns, the bundle of ply-twisted yarns fed to the machine need not have twist, although twist can be put into the bundle if desired.

The preferred ply-twisted yarn is a approximately 750 dtex (665 denier, equivalent to 16/2's cotton count). The ply twist has a twist multiplier of 16.1 (1.68 cotton count twist multiplier), which is equivalent to a 1.9 turns/cm (4.7 turns/inch) in the "S" direction. The final overall composition is 75.5 percent by weight PPD-T staple fiber, 20 percent by weight steel fiber, and 4.5 percent by weight spandex filament.

The sheath/core single yarn (that contains inorganic fiber) used in the preferred ply-twisted yarn is a single 420 dtex (380 denier, equivalent to 14 cotton count) yarn that is DREF spun with a metal core inserted during spinning. The yarn has a Royal Blue colored PPD-T staple sheath, the PPD-T having a 3.8 cm (1.5 inch) cut length and a filament density of 1.7 dtex per filament (1.5 denier per filament). The metal core is a 50 micron (2 mil) stainless steel filament. Approximately 65 weight percent of the single yarn is comprised of the PPD-T staple and 35 weight percent of the steel core.

The elastomeric single yarn used in the preferred ply-twisted yarn is a single 330 dtex (295 denier, equivalent to 18 cotton count) yarn that is ring-spun. The yarn has a natural PPD-T staple sheath that partially covers the elastomeric core filaments, the PPD-T having a 4.8 cm (1.89 inch) cut length and a filament density of 1.7 dtex per filament (1.5 denier per filament). The elastomeric core is a 78 dtex (70 denier) spandex coalesced filament yarn having a 2.4× stretch ratio (approximately 140 percent elongation). The yarn has a twist multiplier of 30.6 (3.2 cotton count TM), which is equivalent to 5.3 turns/cm (13.58 turns/inch) in the "Z" direction. Approximately 90 weight percent of the single yarn is comprised of the PPD-T staple and 10 weight percent of the elastomeric core.

Cut Resistant Fabric and Process for Making Such

The invention also relates to a cut-resistant woven or knitted fabric made from a bundle of yarns comprising at least one single yarn having a sheath/core construction, the sheath being comprised of cut-resistant staple fibers and the core comprised of a inorganic fiber; and at least one single yarn comprising cut resistant staple fiber and at least one elastomeric filament and being free of inorganic fibers. The elastomeric filament incorporated into these yarn bundles provides improved stretch and recovery. The cut resistant organic staple fibers and inorganic filaments incorporated into these yarn bundles provide the fabric with excellent cut resistance. Fabrics made from such yarn bundles are soft, comfortable and non-abrasive as well as cut resistant.

Figure 7:
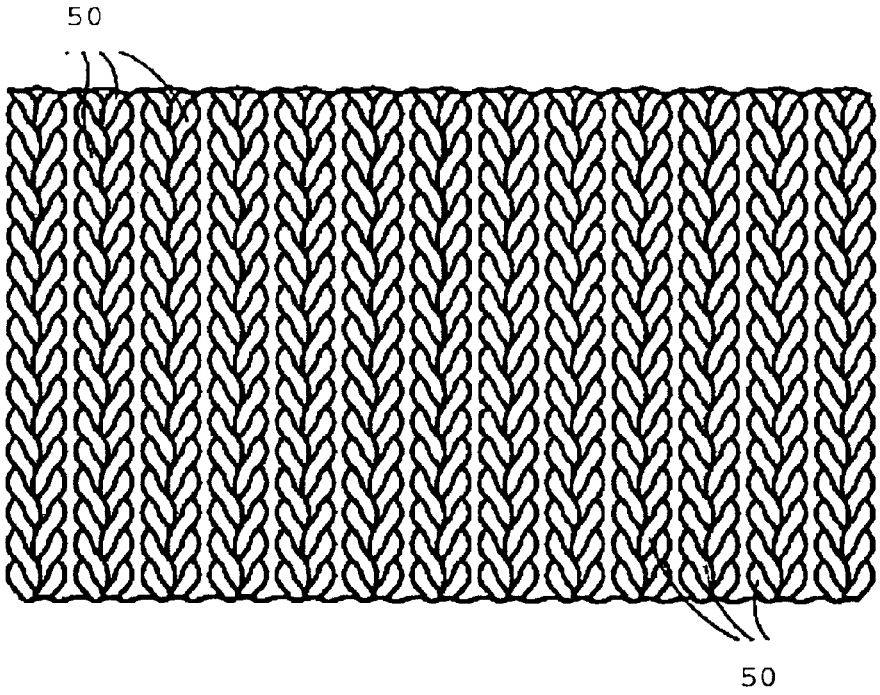
FIG. 7 is a representation of a fabric of this invention made from bundles of ply-twisted or single yarns.

Referring to the Figures, FIG. 7 is a representation of a preferred fabric of this invention made with yarn bundle 50 shown in the fabric pattern. A "yarn bundle" is one or more ply-twisted yarns or a plurality of single yarns or a combination of ply-twisted yarns and single yarns. The preferred yarn bundle has one to three ply-twisted yarns, each of the ply-twisted yarns comprised of a staple fiber sheath/metal core single yarn ply-twisted with staple fiber elastomeric single yarn. However, all of the ply-twisted or single yarns in the yarn bundle or the fabric do not have to be the same. Also, the yarn bundle may contain only single yarns that are not ply-twisted together but are simply collected together into a bundle and fed to a knitting machine to make knitted fabric. However, that bundle of yarn must contain at least one staple fiber sheath/inorganic core single yarn and at least one staple fiber elastomeric single yarn. Ply-twisting of the single yarns is preferred because the ply-twisting helps hold the elastomer single yarn in an extended state without looping upon itself when relaxed. However, if the sheath/core elastomeric single yarn is co-fed with other single yarns in a bundle to a knitting or weaving device with good tension control an acceptable fabric can be made. When the bundle is comprised of ply-twisted yarns tension control of the yarns while knitting and weaving is less critical.

The preferred fabric is a knit fabric, and any appropriate knit pattern is acceptable. Cut resistance and comfort are affected by tightness of the knit and that tightness can be adjusted to meet any specific need. A very effective combination of cut resistance and comfort for many cut resistant articles has been found in, for example, single jersey and terry knit patterns. The fabrics have a basis weight in the range of 4 to 30 oz/yd2, preferably 6 to 25 oz/yd2, the fabrics at the high end of the basis weight range providing more cut protection.

This invention also relates to a process for making a cut resistant fabric, comprising first forming a bundle of yarns, the bundle comprising (a) at least one single yarn comprised of a cut-resistant staple fiber and a continuous elastomeric filament and being free or substantially free of inorganic fibers, the elastomeric filament being incorporated into the first single yarn while stretched under tension, and (b) at least one single yarn having a sheath/core construction with a sheath comprising cut resistant staple fibers and an inorganic fiber core; and then knitting or weaving the bundle of yarns into a fabric. Preferably, the elastomeric single yarn and the sheath/core single yarn are ply-twisted together in the bundle of yarns. The single yarns are typically ply-twisted together to form a ply-twisted yarn, as disclosed previously, and then preferably this ply-twisted yarn can be combined with other ply-twisted yarns to form a yarn bundle. The single yarns can be ply-twisted together with a Tex system twist multiplier of from 4.8 to 28.7 (cotton count twist multiplier of 0.5 to 3.0), preferably with a Tex system twist multiplier of from 6.7 to 20 (cotton count twist multiplier of 0.7 to 2.1. The inorganic fiber used in the sheath/core single yarns is preferably a metal fiber.

The yarn bundle, comprised of single yarns, ply-twisted yarns, or a combination of both, is then fed to a knitting or weaving device to make a knitted or woven cut-resistant fabric.

Test Methods

Cut Resistance. The method used is the "Standard Test Method for Measuring Cut Resistance of Materials Used in Protective Clothing", ASTM Standard F 1790-97. In performance of the test, a cutting edge, under specified force, is drawn one time across a sample mounted on a mandrel. At several different forces, the distance drawn from initial contact to cut through is recorded and a graph is constructed of force as a function of distance to cut through. From the graph, the force is determined for cut through at a distance of 25 millimeters and is normalized to validate the consistency of the blade supply. The normalized force is reported as the cut resistance force.

The cutting edge is a stainless steel knife blade having a sharp edge 70 millimeters long. The blade supply is calibrated by using a load of 400 g on a neoprene calibration material at the beginning and end of the test. A new cutting edge is used for each cut test.

The sample is a rectangular piece of fabric cut 50×100 millimeters on the bias at 45 degrees from the warp and fill directions. The mandrel is a rounded electroconductive bar with a radius of 38 millimeters and the sample is mounted thereto using double-face tape. The cutting edge is drawn across the fabric on the mandrel at a right angle with the longitudinal axis of the mandrel. Cut through is recorded when the cutting edge makes electrical contact with the mandrel.

Comfort. In tests for comfort associated with this invention, for each item, glove samples were prepared to test for comfort and feel. Test handlers tried on each glove without knowledge of what the item was. The test handler was asked to rank the item according to the fit and comfort of the glove. By fit it is meant how well the glove conforms to the hand. By comfortable it is meant whether the glove felt too loose or too tight to the test handler.

The objective was to select the glove with the optimum degree of dexterity and form fitting of the glove to the hand without the glove feeling too tight or too loose. The test handlers rated all of the glove samples and the ratings were averaged and are reported in the Table below.

EXAMPLES

Preparation of Single Yarns Having an Inorganic Core

A sheath/core single yarn was made comprising cut-resistant aramid fibers and stainless steel monofilament. The aramid fibers were poly(p-phenylene terephthalamide) fibers about 3.8 centimeters long and 1.6 dtex per filament sold by E. I. du Pont de Nemours and Company under the trade name Kevlar® staple aramid fiber, Type 970. The steel monofilament was a 50 micron diameter 304L stainless steel sold by Bekaert Corporation under the trade name Bekinox® VN 50/1.

The aramid fibers were fed through a standard carding machine used in the processing of short staple ring spun yarns to make carded sliver. The carded sliver was processed using two pass drawing (breaker/finisher drawing) into drawn sliver and processed on a roving frame to make a 1.2 hank (4920 dtex) roving.

Sheath-core yarns were produced by ring-spinning two ends of the roving and inserting the steel core just prior to twisting. In these examples, the steel core was centered between the two drawn roving ends just prior to the final draft rollers. 14/1s cc yarns (421 dtex linear density) were produced using a 30.1 twist multiplier (3.15 cotton count TM) with "Z" twist.

Preparation of Elastomeric Single Yarns

An elastomeric single yarn comprising aramid cut-resistant staple fibers and elastomeric filaments was made. The aramid fibers were again poly(p-phenylene terephthalamide) fibers about 3.8 centimeters long and 1.6 dtex per filament sold by E. I. du Pont de Nemours and Company under the tradename Kevlar® staple aramid fiber, Type 970. The elastomer was a spandex composition of 44 dtex coalesced monofil sold by E. I. du Pont de Nemours company under the tradename Lycra® Spandex Coalesced Monofil, Type 146.

The aramid fibers were fed through a standard carding machine used in the processing of short staple ring spun yarns to make carded sliver. The carded sliver was processed using two pass drawing (breaker/finisher drawing) into drawn sliver and processed on a roving frame to make a 1.2 hank (4920 dtex) roving.

Sheath-core yarns with spandex cores were produced by ring-spinning two ends of the roving and inserting one or two tensioned spandex cores just prior to twisting. The spandex core(s) were centered between the two drawn roving ends just prior to the final draft rollers. The spandex was tensioned/drawn by underfeeding the material at a slower speed (S2) than the final yarn speed (S1). 18/1s cc yarns (328 dtex linear density) were produced using a 30.1 twist multiplier (3.15 cotton count TM) for each item with "Z" twist. A control yarn was also produced with no spandex core.

One and two ends of spandex cores were used at five different levels of tension. The amount of tension or stretch is determined by the speed ratio of the initial spandex feeder speed (S2) to the final draft roller (and yarn) speed (S1), this ratio (S1/S2) being shown as the stretch or draw ratio in the table below).

The following elastomeric single yarns were produced:

| Item | No. of 44 dtex Spandex Ends | Stretch Ratio (S1/S2) |
|---|---|---|
| A (control) | 0 | 0 |
| 1 | 1 | 1.33 |
| 2 | 2 | 1.33 |
| 3 | 1 | 1.54 |
| 4 | 2 | 1.54 |
| 5 | 2 | 1.81 |
| 6 | 2 | 2.22 |
| 7 | 2 | 2.85 |

Preparation of Ply-Twisted Yarns, Fabrics, and Gloves

Eight different ply-twisted yarns were made by plying each of the above-described 18/1s cc control and stretched spandex core(s) yarns (1. to 8.) and the 14/1s cc 50 micron steel core yarn described at the beginning of this example with a final linear density of 738 dtex linear density.

item 6, then glove item 3, then glove item 2, etc., with the control glove item A being the worse.

To help simplify the manufacture of the elastomeric single yarn, Glove Item 8 was then generated to duplicate the comfort, fit, and dexterity performance of Glove Item 5 with only one end of spandex used in the single elastomeric yarn versus the two ends used in the single elastomer yarn of Item 5. An elastomeric single yarn was made as described before, however, it was made using only one 77 dtex spandex end of Lycra® Type 146 spandex coalesced monofil. This elastomeric single yarn was ply-twisted with the same aramid fiber sheath/metal core single yarn as described before to make a ply-twisted yarn, which was then knitted into gloves in the same manner as before to make Glove Item 8. When tested, Glove Item 8 had equivalent comfort, fit, and dexterity as Glove Item 5. Data for Glove Item 8 is shown in the Table.

| Glove Item | % Aramid | % Steel | % Spandex | Stretch Ratio | Comfort Rating | Fit Rating | Comments |
|---|---|---|---|---|---|---|---|
| A (Control) | 81 | 19 | 0 | N.A. | 3rd | Last | Good feel, Loosest fit |
| 1 | 76 | 19 | 4.5 | 1.33 | 3rd | 5th | Good feel, looser fit than 2 |
| 2 | 72 | 19 | 9 | 1.33 | 3rd | 3rd | Good feel, looser fit than 3 |
| 3 | 77 | 19 | 3.9 | 1.54 | 3rd | 4th | Good feel, looser fit than 4 |
| 4 | 73 | 19 | 7.8 | 1.54 | 2nd | 2nd | Good feel, looser fit than 5 |
| 5 | 74 | 19 | 6.6 | 1.81 | Best | Best | Best balance of fit and comfort |
| 6 | 76 | 19 | 5.4 | 2.22 | 4th | 2nd | Good fit, tighter feel than 5 |
| 7 | 77 | 19 | 4.2 | 2.85 | 5th | 2nd | Good fit, tighter feel than 6 |
| 8 | 77 | 19 | 4.3 | 0.4 | Best | Best | Same as 5 |

Testing was performed to determine effect of ply twist on the stretch-recovery properties of the final ply-twisted yarn. An optimum level of ply twist was obtained. In a relaxed state, when the ply twisted yarn is too low, the structure will collapse from the spandex containing yarn component, which is in compression. Conversely, when the ply twist is too high, there is not enough mobility in the structure for the spandex-containing component to exhibit the desired stretch recovery properties in the final fabric form.

The optimum level of ply twist depends upon the linear density of the ply-twisted yarn and it's components and the stretch ratio and linear density of spandex containing yarn. For these ply-twisted yarn examples a level of 2 turns per centimeter (5.0 turns per inch) of "S" twist was selected (equal to 16.9 twist multiplier (1.77 cotton count TM).

The ply twisted yarns were knitted into test fabric samples using a standard 13 gauge Sheima Seiki glove knitting machine. Gloves were produced to provide glove samples for subsequent comfort, fit and dexterity testing. Glove samples were made by feeding one end of ply twisted yarn to yield glove samples of about (7.5 oz/yd2) 0.26 kg/m$^2$. Glove samples with yarn content and comfort/fit test results are shown in the Table below.

Glove Item 5 was the sample exhibiting the best comfort, fit and dexterity. Ranking of the samples for comfit, fit and dexterity after glove item 5 was glove item 4, then glove

What is claimed is:

1. A ply-twisted yarn for use in cut resistant fabric, comprising:

(a) at least one single yarn having a sheath/core construction with a sheath comprising cut-resistant staple fibers and a core comprising an inorganic fiber; and (b) at least one single yarn comprising cut resistant staple fiber and at least one continuous elastomeric filament and being free or substantially free of inorganic fibers.

2. The ply-twisted yarn of claim 1, wherein the inorganic fiber is not a glass fiber.

3. The ply-twisted yarn of claim 2, wherein the inorganic fiber is a metal fiber.

4. The ply-twisted yarn of claim 1, wherein the yarn is ply-twisted with a Tex system twist multiplier of from 4.8 to 28.7 (cotton count twist multiplier of 0.5 to 3.0).

5. The ply-twisted yarn of claim 4, wherein the yarn is ply-twisted with a Tex system twist multiplier of from 6.7 to 20 (cotton count twist multiplier of 0.7 to 2.1).

6. The ply-twisted yarn of claim 1, wherein the cut resistant staple fibers are poly(paraphenylene terephthalamide).

7. The ply-twisted yarn of claim 1, wherein the elastomeric fiber is a spandex fiber.

8. A cut resistant fabric comprising the ply-twisted yarn of claim 1.

9. A cut-resistant article comprising the ply-twisted yarn of claim 1.

10. A cut resistant fabric made from a bundle of yarns, said bundle of yarns, comprising:

(a) at least one single yarn having a sheath/core construction with a sheath comprising cut-resistant staple fibers and a core comprising an inorganic fiber; and (b) at least one single yarn comprising cut resistant staple fiber and at least one elastomeric filament and being free or substantially free of inorganic fibers.

11. The cut-resistant fabric of claim 10, wherein the bundle of yarns comprises a single yarn of (a) ply-twisted with a single yarn of (b).

12. The cut-resistant fabric of claim 10, wherein the inorganic fiber is not a glass fiber.

13. The cut-resistant fabric of claim 12, wherein the inorganic fiber is a metal fiber.

14. A cut-resistant article, comprising the cut-resistant fabric of claim 10.

15. A process for making a ply-twisted yarn for a cut resistant fabric, comprising:

(a) combining i) at least one first single yarn comprising a cut resistant staple fiber and a continuous elastomeric filament and being free or substantially free of inorganic fibers, the elastomeric filament being incorporated into the first single yarn while stretched under tension, with ii) at least one second single yarn having a sheath/core construction with a sheath comprising cut resistant staple fibers and an inorganic fiber core; and (b) ply-twisting together the first and second single yarns to form a ply-twisted yarn.

16. The process for making a ply-twisted yarn of claim 15, wherein the first single yarn is ply-twisted with a Tex system twist multiplier of from 4.8 to 28.7 (cotton count twist multiplier of 0.5 to 3.0) with the second single yarn.

17. A process for making a cut resistant fabric, comprising:

(a) forming a bundle of yarns comprising i) at least one first single yarn comprising a cut resistant staple fiber and a continuous elastomeric filament and being free or substantially free of inorganic fibers, the elastomeric filament being incorporated into the first single yarn while stretched under tension, with ii) at least one second single yarn having a sheath/core construction with a sheath comprising cut resistant staple fibers and an inorganic fiber core; and (b) knitting or weaving the bundle of yarns into a fabric.

18. The process for making a cut-resistant fabric of claim 17, wherein the bundle of yarns comprises a single yarn of (i) ply-twisted with a single yarn of (ii).

19. The process for making a cut-resistant fabric of claim 18, wherein the first single yarn is ply-twisted with a Tex system twist multiplier of from 4.8 to 28.7 (cotton count twist multiplier of 0.5 to 3.0) with the second single yarn.

20. The process for making a cut-resistant fabric of claim 18, wherein the inorganic fiber is not a glass fiber.

* * * * *